US006227831B1

(12) United States Patent
Osima et al.

(10) Patent No.: US 6,227,831 B1
(45) Date of Patent: May 8, 2001

(54) COMPRESSOR HAVING AN INCLINED SURFACE TO GUIDE LUBRICANT OIL

(75) Inventors: Toshihiro Osima, Nagoya; Yukio Ogawa, Kariya; Shinichi Watanabe, Chita-gun; Tetsuya Hyakutake, Okazaki; Naoki Hakamada, Okazaki; Mikio Matsuda, Okazaki, all of (JP)

(73) Assignee: Denso Corporation, Aichi-Pref. (JP)

( * ) Notice: Subject to any disclaimer, the term of this patent is extended or adjusted under 35 U.S.C. 154(b) by 0 days.

(21) Appl. No.: 09/338,604

(22) Filed: Jun. 23, 1999

(30) Foreign Application Priority Data

Jun. 24, 1998 (JP) ..... 10-177733
Feb. 3, 1999 (JP) ..... 11-026422

(51) Int. Cl.[7] ..... F04C 18/04; F04C 27/00; F04C 29/02; F01M 9/12

(52) U.S. Cl. ..... 418/55.4; 418/55.6; 418/104; 418/DIG. 1; 184/6.16

(58) Field of Search ..... 418/55.4, 55.6, 418/104, DIG. 1; 184/6.16

(56) References Cited

U.S. PATENT DOCUMENTS

| | | | | |
|---|---|---|---|---|
| 2,212,717 | | 8/1940 | Penn . | |
| 4,082,484 | * | 4/1978 | McCullough | 418/55.4 |
| 4,314,796 | * | 2/1982 | Terauchi | 418/55.6 |
| 4,538,975 | * | 9/1985 | Tsukagoshi | 418/55.6 |
| 4,834,634 | * | 5/1989 | Ono | 418/104 |
| 5,456,584 | | 10/1995 | Isomura et al. | 418/55.1 |
| 5,499,515 | * | 3/1996 | Kawamura et al. | 418/DIG. 1 |
| 5,531,578 | | 7/1996 | Takemoto et al. | 418/55.1 |
| 5,569,028 | * | 10/1996 | Yamamura et al. | 418/55.4 |
| 5,575,635 | | 11/1996 | Yamamoto et al. | 418/55.6 |
| 5,681,155 | | 10/1997 | Hisanaga et al. | 418/55.5 |

FOREIGN PATENT DOCUMENTS

| | | | | |
|---|---|---|---|---|
| 30 13 006 | | 10/1980 | (DE) . | |
| 44 21 771 | | 1/1995 | (DE) . | |
| 0 009 350 | | 4/1980 | (EP) . | |
| 468238 | * | 1/1992 | (EP) | 418/55.4 |
| 0 600 313 | | 6/1994 | (EP) . | |
| 55-117092 | * | 9/1980 | (JP) | 418/DIG. 1 |
| 63-295890 | * | 12/1988 | (JP) | 418/55.6 |
| 4-153596 | * | 5/1992 | (JP) | 418/DIG. 1 |
| 5-126072 | * | 5/1993 | (JP) | 418/DIG. 1 |
| 7-253088 | | 10/1995 | (JP) . | |
| 7-317671 | | 12/1995 | (JP) . | |
| 8-319981 | | 12/1996 | (JP) . | |

* cited by examiner

*Primary Examiner*—John J. Vrablik
(74) *Attorney, Agent, or Firm*—Pillsbury Winthrop LLP

(57) ABSTRACT

An inclined surface is formed in an upper inside wall of housing. The inclined surface inclines downwardly toward a lip seal. Lubricant oil supplied to the upper end of the inclined surface flows along the inclined surface without dropping downwardly due to surface tension, and flows to the lower end of the inclined surface then reaches the lip seal. Thus, the lubricant oil is supplied to the lip seal with certainty, thereby suppressing the wear of the lip seal and improving the durability of the compressor.

4 Claims, 4 Drawing Sheets

COMPRESSOR HAVING AN INCLINED SURFACE TO GUIDE LUBRICANT OIL

CROSS REFERENCE TO RELATED APPLICATION

This application is based on and incorporates herein by reference Japanese Patent Application Nos. Hei. 10-177733 filed on Jun. 24, 1998 and Hei. 11-26422 filed on Feb. 3, 1999.

BACKGROUND OF THE INVENTION

1. Field of the Invention

The present invention relates to a compressor suitable for use in a refrigerating cycle, such as for an automotive air conditioning system.

2. Description of Related Art

A lip seal of a compressor seals a gap between a shaft and housing for preventing fluid being compressed from flowing out of the compressor. Because the shaft rotates, lubricant oil needs to be supplied to the lip seal to lubricate the shaft and lip seal.

JP-A-7-253088 discloses that the lubricant oil is supplied to a bearing disposed near the lip seal. Further, this lubricant oil is led and supplied to the lip seal.

However, in JP-A-7-253088, when an insufficient amount of lubricant oil is supplied to the bearing, the lubricant oil is not supplied to the lip seal.

SUMMARY OF THE INVENTION

An object of the present invention is to provide a compressor in which a sufficient amount of lubricant oil supplied to the inside of the housing reaches the lip seal.

According to a first aspect of the present invention, an inclined surface is formed in an upper inside wall of the housing, and the inclined surface inclines downwardly toward the lip seal. The lubricant oil supplied to the upper end of the inclined surface flows along the inclined surface without dropping downwardly due to surface tension, and reaches the lip seal. Thus, sufficient lubricant oil is always led and supplied to the lip seal, thereby reducing the wear of the lip seal and improving the durability of the compressor.

According to second aspect of the present invention, an injection passage conducts the lubricant oil from an oil storage chamber to the upper end of the inclined surface due to a pressure difference between a fluid suction side and fluid discharge side of a compression mechanism. Thus, the lubricant oil is led and supplied to the lip seal with greater certainty than in the first aspect of the present invention.

According to third aspect of the present invention, grooves are formed in parallel on the outer surface of a balance weight in a scroll type compressor. Further, the grooves are inclined toward the lip seal as the balance weight rotates. The balance weight rotates and works as a screw pump to lead the lubricant oil to the lip seal. Thus, the lubricant oil is supplied to the lip seal with certainty, thereby reducing the wear of the lip seal.

According to fourth aspect of the present invention, an injector is formed in the inside wall of the balance weight in a scroll type compressor. The lubricant oil stored within the inside wall is injected and led to the lip seal due to centrifugal force of the balance weight. Thus, the lubricant oil is led to the lip seal with certainty.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS (First Embodiment)

Figure 1:
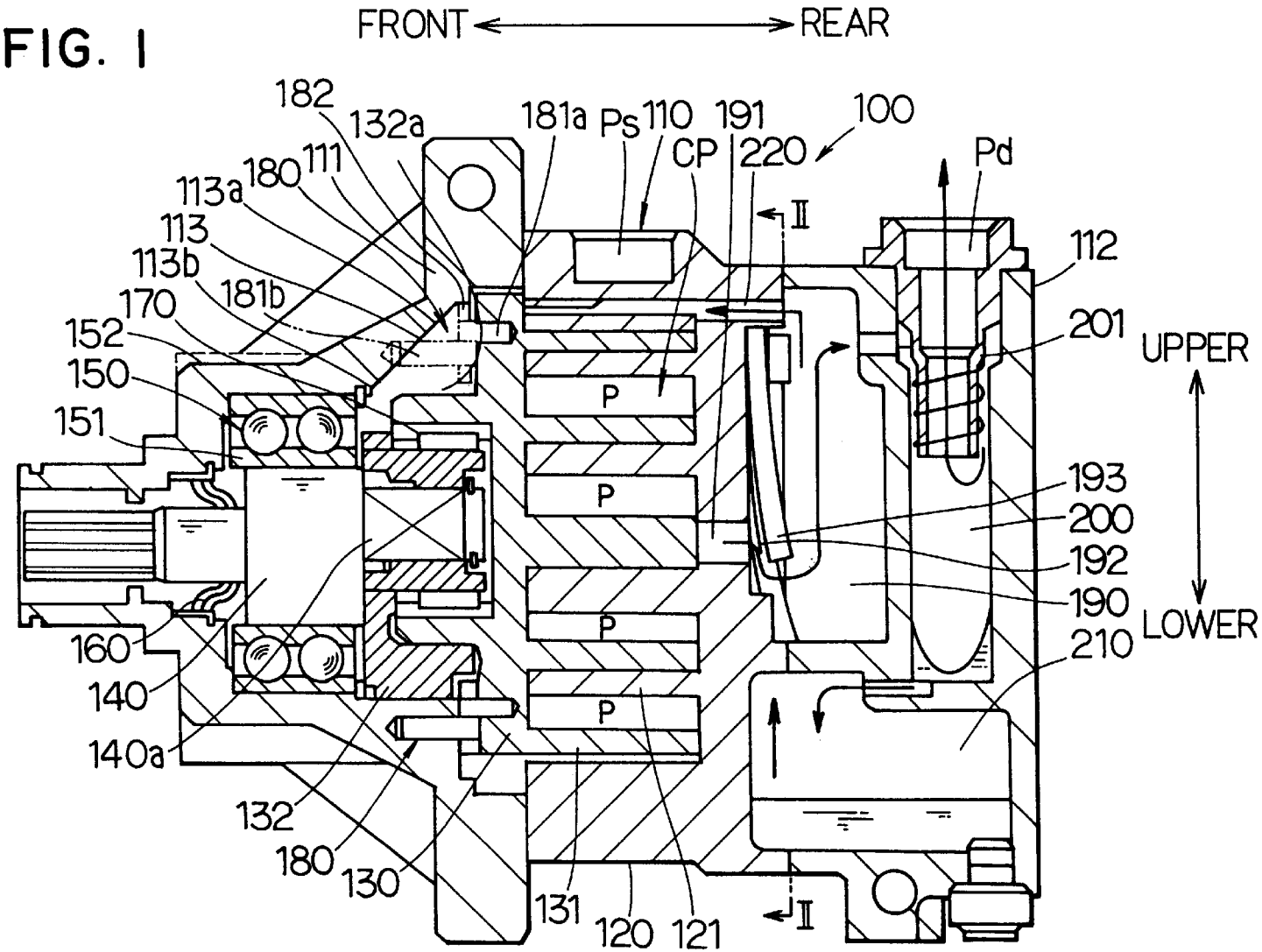
FIG. 1 is a cross sectional view showing a scroll type compressor (first embodiment)

In the first embodiment, a scroll type compressor 100 is applied to a refrigerating cycle for an automotive air conditioning system. FIG. 1 shows a cross sectional view of the scroll type compressor 100.

An outer casing of the compressor 100 includes a center housing 110, a front housing 111 and a rear housing 112. A fixed scroll member 120 is formed integrally with the center housing 110. A movable scroll member 130 is provided in the outer casing and orbits with respect to the fixed scroll member 120. Scroll members 120 and 130 include spiral formed scroll teeth 121 and 131 respectively. These scroll teeth 121 and 131 form an operation chamber P that suctions and compresses refrigerant by expanding and contracting the volume thereof. That is, a compression mechanism CP is constructed by the fixed and movable scroll members 120 and 130 and expands and contracts the operation chamber P. The refrigerant is suctioned through a suction inlet Ps from an evaporator (not illustrated) of the refrigerating cycle, and discharged through a discharge outlet Pd to a condenser (not illustrated) of the refrigerating cycle.

A shaft 140 is supported rotatably in the front housing 111, and transmits a rotational force to the movable scroll member 130. The front end of the shaft 140 protrudes out the front housing 111. A vehicle engine (not illustrated) rotates the shaft 140 through an electromagnetic clutch (not illustrated) connected with the front end thereof.

A ball bearing 150 is disposed in the front housing 111. The ball bearing 150 supports the shaft 140 to be allowed to rotate. A lip seal 160 is provided near the ball bearing 150 at the electromagnetic clutch side thereof. The lip seal 160 seals the gap between the shaft 140 and the front housing 111 to prevent the refrigerant from flowing out of the front housing 111.

The shaft 140 includes an eccentric portion 140*a* at the rear end thereof. The movable scroll member 130 is connected to the eccentric portion 140*a* through a bearing 170. A pair of pins 181*a* and 181*b* and a ring 182 construct a rotation block mechanism 180. When the shaft 140 rotates, the movable scroll member 130 orbits the center of the shaft 140 without rotating.

A balance weight 132 is provided at the eccentric portion 140*a*. The balance weight 132 rotates with the shaft 140 and cancels the centrifugal force of the movable scroll member 130.

A discharge chamber 190 is provided in the rear housing 112, and reduces the pressure pulsations of the refrigerant discharged from the operation chamber P. The operation chamber P and the discharge chamber 190 communicate with each other through a discharge port 191. A discharge valve 192 and a stopper 193 are provided at the discharge port 191. The discharge valve 192 is a lead type valve preventing the refrigerant from flowing back from the discharge chamber 190 into the operation chamber P. The stopper 193 restricts the maximum opening degree of the discharge valve 193.

An oil separation mechanism 200 is provided in the rear housing 112. The oil separation mechanism 200 separates the lubricant oil from the refrigerant discharged from the compression mechanism CP. An oil storage chamber 210 is formed in the rear housing 112 for storing the lubricant oil separated from the refrigerant.

Here, the oil separation mechanism 200 includes a columnar shaped separation pipe 201 of which inside space communicates with a discharge outlet Pd. The refrigerant including lubricant oil spouts toward the outer surface of the separation pipe 201 and turns around the separation pipe 201 whereby separates the lubricant oil by centrifugal force.

An injection passage 220 is formed in the center housing 110 for leading and injecting the lubricant oil in the oil storage chamber 210 toward the suction side of the compression mechanism CP and a space 132*a* where the balance weight 132 rotates.

Figure 2:
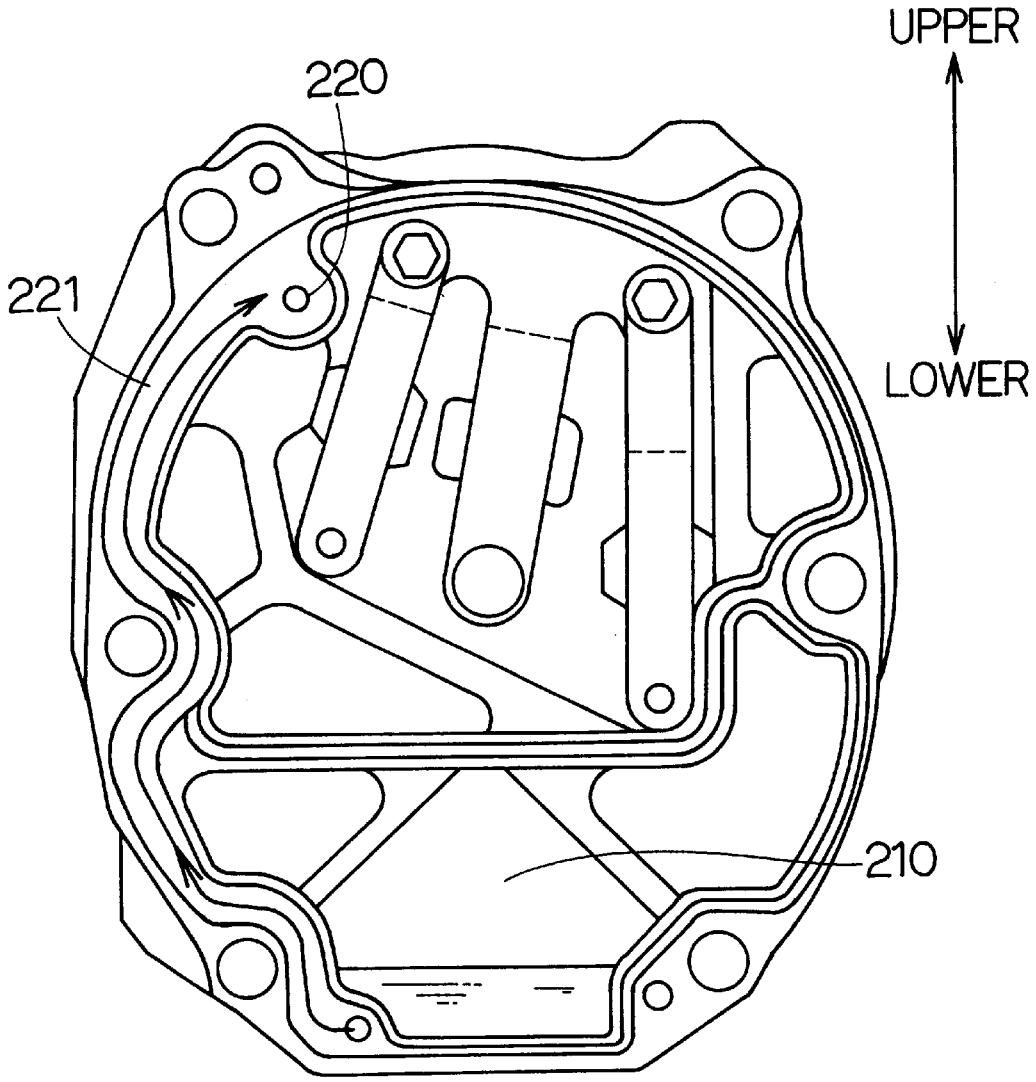
FIG. 2 is a cross sectional view taken along line II—II in FIG. 1.

The injection passage 220 and the oil storage chamber 210 communicate with each other through a lubricant oil passage 221 (see FIG. 2). The lubricant oil passage 221 is provided by a particular hole formed in a gasket (not illustrated) disposed between the center housing 110 (fixed scroll member 120) and the rear housing 112.

The upper inside wall of the front housing 111, which forms the space 132*a,* as shown in FIG. 1, includes inclined surface 113 which inclines downwardly toward the ball bearing 150. The lower end 113*b* of the inclined surface 113 joins with the portion where the ball bearing 150 is disposed. The lubricant oil supplied from the injection passage 220 to the space 132*a* blows toward the upper end 113*a* of the inclined surface 113.

The inclined surface 113 does not need to be formed across the entire width of the inside wall of the front housing 111 from side to side. That is, it is sufficient to form the inclined surface 113 with a predetermined width and at a lateral position only opposite to the injection passage 220.

In the scroll compressor 100 described in this embodiment, the lubricant oil of the oil storage chamber 210 is supplied to the upper end 113*a* of the inclined surface 113. Thus, the lubricant oil flows along the inclined surface 113 due to surface tension to the lower end 113*b* without dropping downwardly to the balance weight 132 side.

The lubricant oil reaches the lower end 113*b* and is suctioned into the inside of the ball bearing 150 by the rotation thereof. Further, the lubricant oil goes through the gap between an inner race 151 and an outer race 152, and reaches the lip seal 160. That is, the inclined surface 113 functions as a lubricant promotion wall directing the lubricant oil to the ball bearing 150 and the lip seal 160 with certainty.

As described above, in the present embodiment, the lubricant oil supplied to the inside wall of the front housing 111 can be led with certainty to the ball bearing 150 and the lip seal 160. Thus, the wear of the lip seal 160 is suppressed, thereby improving the compressor durability.

(Second Embodiment)

In the second embodiment, as shown in FIGS. 3A–3D, a plurality of grooves 132*c* are formed in parallel on the outer surface 132*b* of the balance weight 132. The plural grooves are inclined toward the front of the compressor (toward the lip seal 160) as the balance weight 132 rotates in direction D.

Figure 3A:
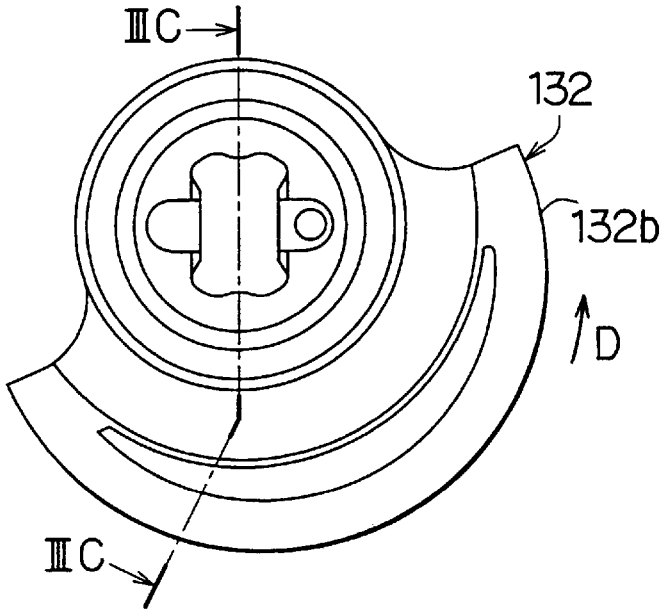
FIG. 3A is a front view showing a balance weight from a movable scroll member side (second embodiment)
Figure 3C:
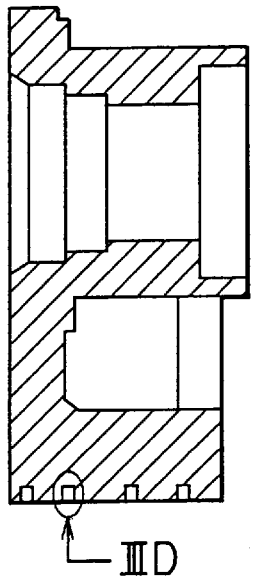
FIG. 3C is a cross sectional view taken along line IIIC—IIIC line in FIG. 3A.
Figure 3B:
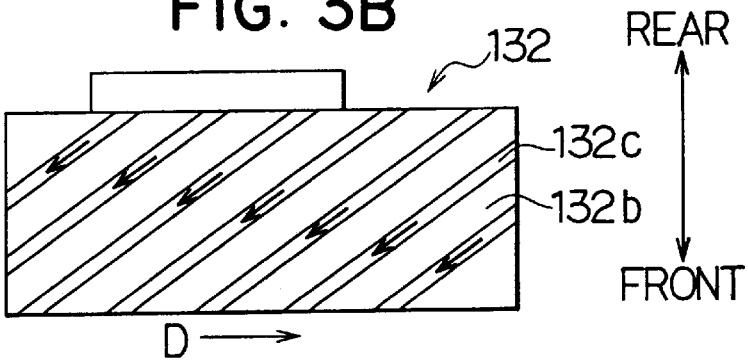
FIG. 3B is a bottom plan view showing the balance weight.
Figure 3D:
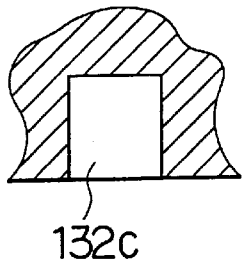
FIG. 3D is an enlarged view of part IIID in FIG. 3C.

In the present second embodiment, as denoted by arrow in FIG. 3B, the rotating balance weight 132 functions as a screw pump to lead the lubricant oil supplied to the space 132*a* to the ball bearing 150 and the lip seal 160. Lubricant oil decends by gravity from the lip seal 160 toward the lower area of the balance weight 132, and is supplied, for example, to the outer circumference of the balance weight 132, as can be seen from FIG. 1.

Therefore, the lubricant oil is led to the ball bearing 150 and the lip seal 160 with certainty, thereby suppressing the wear of the lip seal 160.

(Third Embodiment)

In the third embodiment, as shown in FIGS. 4A–4G, injectors 230 are provided in the balance weight 132.

The injectors 230 inject the lubricant oil stored on the inside wall 132*e* of the balance weight 132 into the ball bearing 150 and the lip seal 160 by centrifugal force of the balance weight 132.

Figure 4A:
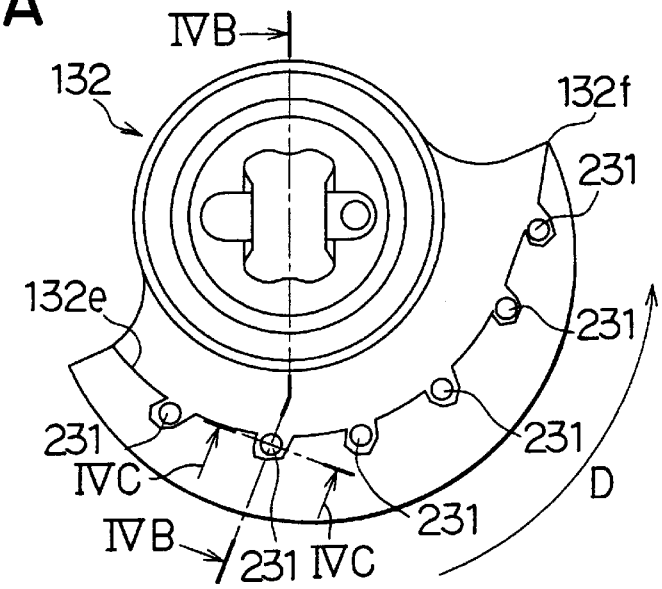
FIG. 4A is a front view showing a balance weight from a movable scroll member side (third embodiment)
Figure 4B:
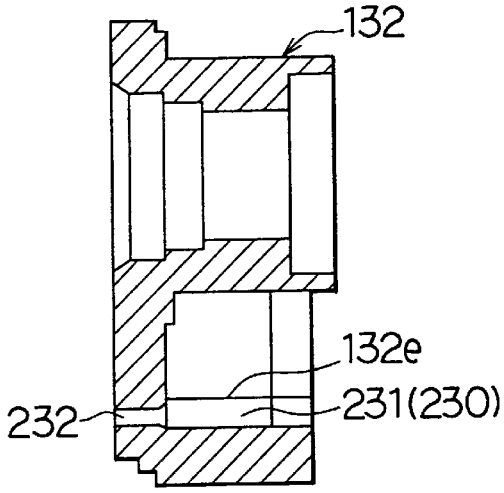
FIG. 4B is a cross sectional view taken along line IVB—IVB in FIG. 4A.
Figure 4C:
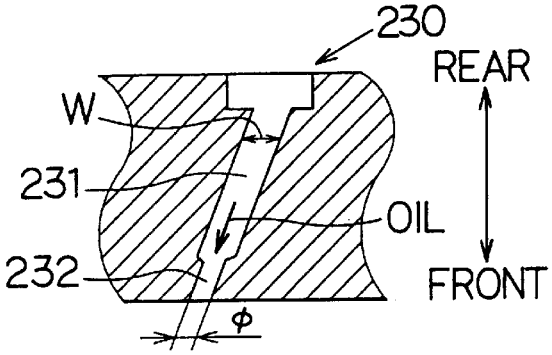
FIG. 4C is a cross sectional view taken along line IVC—IVC in FIG. 4A.

Each injector 230, as shown in FIGS. 4B and 4C, includes a groove 231 formed on the inside wall 132*e* of the balance weight 132 to extend in the same direction as the groove 132*c* described in the second embodiment. The groove 231 opens at the front end, i.e. the ball bearing 150 side end, of the balance weight 132 to form an injection port 232. The injector 230 temporarily stores the lubricant oil on the inside wall 132*e* of the balance weight 132.

When the balance weight 132 rotates, the lubricant oil stored on the inside wall 132*e* is injected from the injection port 232 toward the ball bearing 150 and the lip seal 160 by centrifugal force of the balance weight. Thus, the lubricant oil is led to the ball bearing 150 and the lip seal 160 with certainty, thereby suppressing the wear of the lip seal 160.

Here, the outer and front end 132*f* in the rotation direction D of the balance weight 132 tapers to become pointed. Thus, the lubricant oil supplied to the space 132*a* is efficiently stored on the inside wall 132*e*.

The hole diameter $\phi$ is smaller than the width W of the groove 231. Thus, the dynamic pressure of the lubricant oil injected from the injection port 232 rises to help the lubricant oil to reach the ball bearing 150 and the lip seal 160 with certainty.

(Modifications)

In the above-described embodiments, the present invention is applied to a scroll type compressor. The present invention is not restricted to the scroll type compressor and alternatively may be applied to other type compressors.

Further, in the second and third embodiments, there is no need to provide an inclined surface 113 described in the first embodiment.

What is claimed is:

1. A compressor to compress fluid including lubricant oil comprising:

a housing forming an outer casing;

a compression mechanism provided in said housing for suctioning and compressing said fluid;

a shaft rotatably supported by said housing, said shaft transmitting a rotational force to said compression mechanism;

a balance weight rotating with said shaft, said balance weight canceling centrifugal force of said compression mechanism; and a lip seal provided between said housing and said shaft, said lip seal being in contact with an outer surface of said shaft to seal a gap between said housing and said shaft, wherein said housing defines a space therein where said balance weight rotates, said space defines an upper inside wall thereof, said upper inside wall includes an inclined surface adjacent the balance weight and inclining downwardly toward said lip seal, and said lubricant oil is supplied to the upper end of said inclined surface.

2. A compressor to compress fluid including lubricant oil comprising:

a housing forming an outer casing;

a compression mechanism provided in said housing for suctioning and compressing said fluid, said compression mechanism defining a fluid suction side and a fluid discharge side;

a shaft rotatably supported by said housing, said shaft transmitting a rotational force to said compression mechanism;

a balance weight rotating with said shaft, and canceling centrifugal force of said compression mechanism;

a lip seal provided between said housing and said shaft, said lip seal being in contact with an outer surface of said shaft to seal a gap between said housing and said shaft;

an oil separation mechanism for separating said lubricant oil from said fluid; and an oil storage chamber for storing said oil separated by said oil separation mechanism, wherein said housing defines a space therein where said balance weight rotates, said space defines an upper inside wall thereof, said upper inside wall includes an inclined surface adjacent the balance weight and inclining downwardly toward said lip seal, and said housing includes an injection passage for leading said lubricant oil stored in said oil storage chamber to the upper end of said inclined surface due to a pressure difference between said fluid suction side and said fluid discharge side of said compression mechanism.

3. A compressor according to claim 2, wherein said oil separation mechanism includes a columnar shaped oil separation pipe for separating said lubricant oil from said fluid due to centrifugal force.

4. A scroll type compressor to compress fluid including lubricant oil comprising:

a housing forming an outer casing:

a scroll type compression mechanism provided in said housing for suctioning and compressing said fluid, said scroll type compression mechanism defining a fluid suction side and a fluid discharge side, said scroll type compression mechanism including a fixed scroll member fixed to said housing and a movable scroll member orbiting with respect to said fixed scroll member;

a shaft rotatably supported by said housing, said shaft transmitting a rotational force to said movable scroll member;

a bearing disposed in said housing to support said shaft rotatably;

a balance weight rotating with said shaft, and canceling centrifugal force of said movable scroll member;

a lip seal provided between said housing and said shaft, said lip seal being in contact with an outer surface of said shaft to seal a gap between said housing and said shaft;

an oil separation mechanism for separating said lubricant oil from said fluid; and an oil storage chamber for storing said oil separated by said oil separation mechanism, wherein said housing defines a space therein where said balance weight rotates, said space defines an upper inside wall thereof, said upper inside wall includes an inclined surface adjacent the balance weight and inclining downwardly toward said bearing, and said housing includes an injection passage for leading said lubricant oil stored in said oil storage chamber to the upper end of said inclined surface due to a pressure difference between said fluid suction side and said fluid discharge side of said scroll type compression mechanism.

* * * * *